United States Patent [19]

Carter

[11] 4,392,048

[45] Jul. 5, 1983

[54] ELECTRICAL CONVERTOR HEATER

[75] Inventor: Brian Carter, Paris, France

[73] Assignee: Societe Prl, Aubervilliers, France

[21] Appl. No.: 314,513

[22] Filed: Oct. 23, 1981

Related U.S. Application Data

[63] Continuation of Ser. No. 8,340, Jan. 31, 1979, abandoned.

[30] Foreign Application Priority Data

Feb. 1, 1978 [GB] United Kingdom ..... 4091/78

[51] Int. Cl.[3] ..... F24H 9/02; F24H 9/20; H05B 3/02

[52] U.S. Cl. ..... 219/367; 165/55; 165/128; 219/366

[58] Field of Search ..... 165/55, 128, 129; 219/366, 367

[56] References Cited

U.S. PATENT DOCUMENTS

| | | | |
|---|---|---|---|
| 2,882,381 | 4/1959 | Zellers | 219/377 |
| 2,995,644 | 8/1961 | Zellers | 219/366 |
| 3,076,887 | 2/1963 | Bulow | 219/366 |
| 3,294,158 | 12/1963 | Baljet | 219/367 |

FOREIGN PATENT DOCUMENTS

| | | | |
|---|---|---|---|
| 2707032 | 8/1977 | Fed. Rep. of Germany | 219/366 |
| 197805 | 7/1978 | France | 219/366 |
| 311281 | 7/1930 | United Kingdom . | |
| 415561 | 9/1934 | United Kingdom . | |
| 460918 | 2/1937 | United Kingdom . | |
| 1070206 | 6/1967 | United Kingdom . | |
| 1235211 | 6/1971 | United Kingdom | 219/366 |
| 1405300 | 10/1975 | United Kingdom . | |
| 1535561 | 12/1978 | United Kingdom . | |

*Primary Examiner*—B. A. Reynolds
*Assistant Examiner*—Geoffrey S. Evans
*Attorney, Agent, or Firm*—Wenderoth, Lind & Ponack

[57] ABSTRACT

A convector heater has a front plate 1 with a surround 2 spaced around the periphery of the front plate 1 so as to define a top, bottom and side air gap 3 between the front plate 1 and the surround 2. A back plate 4 is connected at its periphery to the surround 2 and is spaced from the front plate 1 so as to define a convection air space 7 between the front plate 1 and the back plate 4. The convection air space 7 is open to the surrounding atmoshere at the air gap 3. A heat exchanger, such as an electric heater, is disposed at the bottom of the convection air space 7 for heating air to induce a convection air flow through the convection air space 7 from the bottom air gap **3*b* to the top air gap 3*a*. A secondary air flow is induced into the air space 7 through the side gaps 3*c*, 3*d*** by the main convection air flow. A control means is so disposed at a top corner of the convection air space the the air impinging on said control means includes air from said secondary air flow entering through the respective side air gap portion and is cooler than the primary convection air flow leaving the top air gap portion.

7 Claims, 4 Drawing Figures

ELECTRICAL CONVERTOR HEATER

This is a continuation of application Ser. No. 008,340, filed Jan. 31, 1979, now abandoned.

BACKGROUND AND SUMMARY OF THE INVENTION

The present invention relates to a convector heater.

According to the invention there is provided a convector heater comprising a front plate; a surround spaced around the periphery of the front plate so as to define an air gap between the front plate and the surround; a black plate connected at its periphery to the surround and spaced from the front plate so as to define a convection air space between the front plate and the back plate, the convection air space being open to the surrounding atmosphere at the air gap around the periphery of the front plate; and a heat exchanger disposed at the bottom of the air space for air heating to induce a convection air flow from the air gap at the bottom of the front plate, through the convection air space, to the air gap at the top of the front plate, the arrangement being such that a secondary air flow is induced into the air space through the air gap at the sides of the front plate by the main convection air flow.

Conveniently the convector heater is rectangular in shape when viewed from the front.

Preferably, the convector heater includes control means disposed at one of the top corners of the convection air space, the arrangement being such that the air flow impinging on the control means includes air from the secondary air flow entering through the respective side air gap, and is cooler than the main convection air flow leaving the top air gap. Thus the control means is prevented from becoming too hot. Conveniently, the control means is accommodated in a housing attached to the back plate. The housing is preferably of plastics material. The control means may incorporate one or more manual controls which may be made visible from above by virtue of the position of the housing at the top of the back plate. Nevertheless, it is preferable for the housing or controls not to be visible through the air gap.

In addition to cooling the control means, the secondary in-flow of ambient air at the sides may have a further advantage in permitting the heat exchanger to extend the full length of the convection air space. This allows a more efficient use of space than in an arrangement where the heat exchanger terminates short of the end of the cabinet to avoid overheating of the controls.

The air gap through which convection air enters the heater may not be large enough to provide an adequate air flow. Accordingly, apertures may be provided in the back plate for further air to enter the convection air space below the heat exchanger. The heat exchanger is preferably such as is described in British Pat. No. 1,535,561.

BRIEF DESCRIPTION OF THE DRAWINGS

In order that the invention may be more readily understood, a specific embodiment thereof will now be described with reference to the accompanying drawings in which.

DETAILED DESCRIPTION OF THE INVENTION

The illustrated heater has a front plate 1. In the plane of the plate there extends the front of a surround or frame 2 of rectangular section. The top and side portions of the surround are integral whilst the bottom portion is screwed to tabs turned in from the bottom ends of the side portions. The surround 2 and the plate 1 have an air gap 3*a*, 3*b*, 3*c*, 3*d* therebetween along all the edges of the plate 1. The air gap is continuous. Behind front plate 1 is a back plate 4 having forwardly angled portions 5*a*, 5*b* to which the surround 2 is attached. Brackets 6*a* riveted to the back plate 4 support front plate 1 when the heater is in the intended operating position, i.e. on a wall. The bottom of the front plate 1 is secured by tabs 6*b* screwed to tabs 6*c*, the tabs being riveted to the front plate and inside of the surround respectively.

Figure 2:
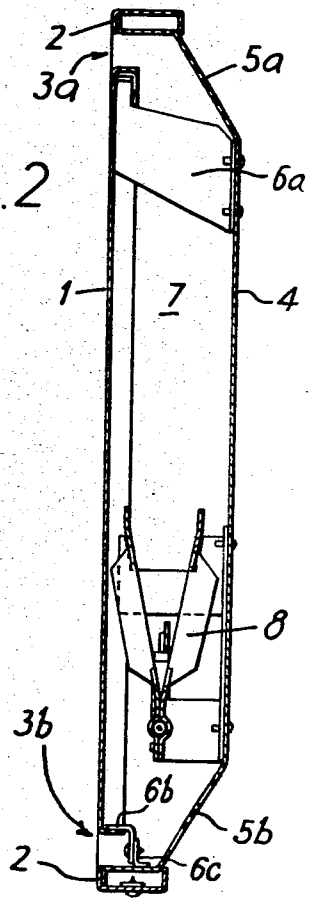
FIG. 2 is a cross-section on the line II—II in FIG. 1.
Figure 1:
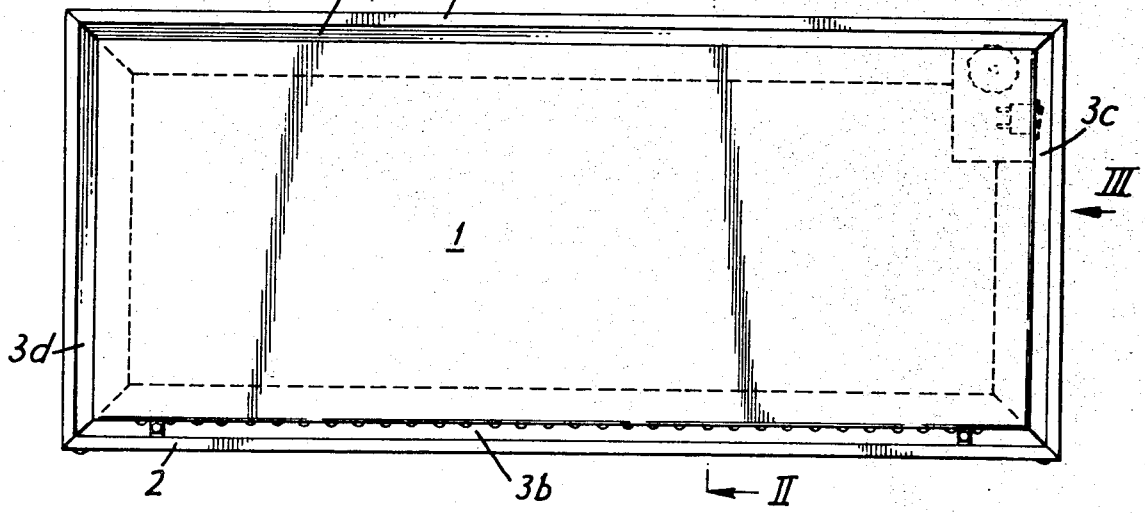
FIG. 1 is a front view of a convector heater according to the invention.
Figure 4:
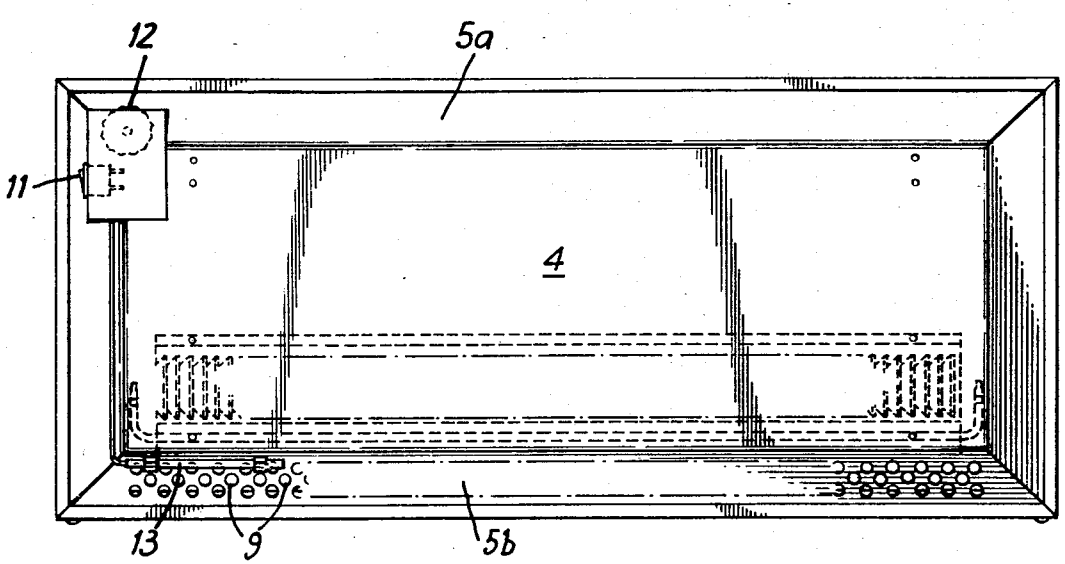
FIG. 4 is a back view of the heater of FIG. 1.
Figure 3:
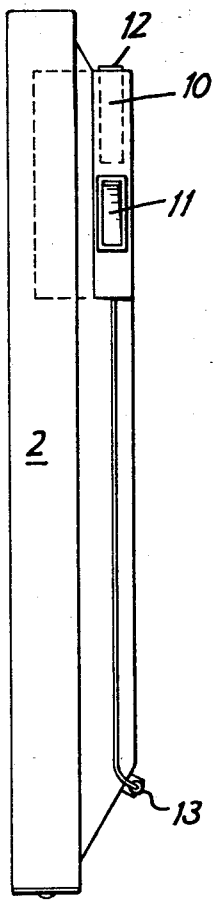
FIG. 3 is an end view in the direction of the arrow III in FIG. 1.

In a convection air space 7, defined between the front plate 1 and the back plate 4, at the bottom thereof is mounted a heat exchanger 8 (see FIG. 2 and FIG. 4 wherein the exchanger is shown in broken line). The heat exchanger is such as is specifically described in British Pat. No. 1,535,561, and has an elongate electrically heated element, a spine surrounding the element and a pair of banks of parallel fins extending upwardly from the spine in Vee formation, each fin being planar, disposed perpendicular to the heat source and in alignment with the convection air flow. In operation, the heat exchanger heats the air in the convection air space 7, which heated air is deflected forwards by top angled portion 5*a* and leaves the heater via the top gap 3*a*. Convection air enters the air space 7 via bottom gap 3*b* and supplementary apertures 9 in lower angled portion 5*b* (see FIG. 4). End gaps 3*c*, 3*d* are also in communication with the convection air space 7. Accordingly, there is a tendency for a secondary flow of ambient air to be drawn in through these gaps 3*c*, 3*d* by the convection air flow passing up the air space 7. This has the effect of cooling the air leaving the top gap 3*a* at the ends thereof. Thus control means contained in a housing 10 of plastics material and positioned at the top right (FIG. 1) corner of the air space can be kept relatively cool. As shown the controls provided are an on/off switch 11 and a thermostat having a scalloped thumbwheel 12 and a sensing tube 13 mounted on the lower angled portion 5*b* to sense the temperature of the air entering the air space through the apertures 9. As can be seen in FIG. 1 neither the housing 10 nor, indeed, the heater element 8 can be seen from the front of the heater. However, the setting of the scalloped thumbwheel can be seen by looking over the surround 2.

The heater described in the specification with reference to the drawing acts, to some extent, as a radiator as well as a convector heater. This is because the flow of convection air through the heater is restricted to the extent that it heats the front plate 1 to a temperature of between 50° C. and 70° C. Thus the front plate radiates heat.

The invention is not intended to be limited to details of the above described embodiment. The thermostat sensor may be differently positioned. For instance, it may be positioned just within the end of the air space to sense the temperature of the ambient air flowing therein. Here it would also function as a cut-out in the event of the top gap 3*a* being covered since the convection air would then flow out of the end gaps 3c, 3d. Further a different heat exchanger may be employed and the sectional shape of the surround and the configuration of the angled portions of the back plate may be varied.

I claim:

1. A convector heater comprising:

a front plate;

a surround spaced around the periphery of said front plate;

an air gap defined between said front plate and said surround and including a top air gap portion, a bottom air gap portion and two lateral end air gap portions, said top, bottom and lateral end air gap portions being of similar width and said air gap being continuous around the entire periphery of said front plate;

a back plate connected at the periphery thereof to said surround and spaced from said front plate;

a convection air space defined between said front plate and said back plate, said convection air space being directly connected to and opening into the surrounding atmosphere around the entire periphery of said front plate through said top, bottom and two lateral end air gap portions;

heat exchanger means disposed in said convection air space at the bottom thereof for inducing a primary convection air flow inwardly through said bottom air gap portion at the bottom of said front plate; upwardly through said convection air space, and outwardly through said air gap portion at the top of said front plate, and for causing said primary convection air flow to induce secondary convection air flows inwardly through said lateral end air gap portions, upwardly through said convection air space, and outwardly through said top air gap portion; and control means disposed at one of the top corners of said convection air space, the arrangement being such that the air flow impinging on said control means includes air from said secondary air flow entering through said respective lateral end air gap portion and is cooler than said primary convection air flow leaving said top air gap portion.

2. A convector heater as claimed in claim 1, wherein said convector heater is rectangular in front elevation.

3. A convector heater as claimed in claim 2, wherein said heat exchanger means extends across the entire width of said convection air space.

4. A convector heater as claimed in claim 1, further comprising a plastic housing attached to said back plate for housing said control means.

5. A convector heater as claimed in claim 1, wherein said back plate includes an upper portion which slopes forwardly.

6. A convector heater as claimed in claim 1, wherein the bottom portion of said back plate has apertures through which air may flow to augment said primary convection air flow.

7. A convector heater as claimed in claim 1, wherein said heat exchanger means comprises;

an elongate electrically heated element;

a spine surrounding said element; and a pair of banks of parallel fins extending upwardly from said spine in Vee formation, each fin being planar, disposed perpendicular to said heated element and in alignment with said primary convection air flow.

* * * * *